US008360200B2

(12) United States Patent
Sugishita

(10) Patent No.: US 8,360,200 B2
(45) Date of Patent: Jan. 29, 2013

(54) MUFFLER

(75) Inventor: Yuu Sugishita, Kawagoe (JP)

(73) Assignee: Husqvarna Zenoah Co., Ltd., Kawagoe-shi (JP)

( * ) Notice: Subject to any disclaimer, the term of this patent is extended or adjusted under 35 U.S.C. 154(b) by 83 days.

(21) Appl. No.: 12/294,825

(22) PCT Filed: Mar. 27, 2007

(86) PCT No.: PCT/JP2007/056402

§ 371 (c)(1),
(2), (4) Date: Sep. 26, 2008

(87) PCT Pub. No.: WO2007/116737

PCT Pub. Date: Oct. 18, 2007

(65) Prior Publication Data

US 2010/0163337 A1 Jul. 1, 2010

(30) Foreign Application Priority Data

Mar. 28, 2006 (JP) ..... 2006-089011

(51) Int. Cl.
*F01N 13/10* (2010.01)

(52) U.S. Cl. ..... 181/240; 181/231

(58) Field of Classification Search ..... 181/231, 181/240

See application file for complete search history.

(56) References Cited

U.S. PATENT DOCUMENTS 4,418,790 A * 12/1983 Agnew ..... 181/268
5,451,728 A * 9/1995 Chandler et al. ..... 181/230
5,722,237 A * 3/1998 Iida et al. ..... 60/302
5,732,555 A * 3/1998 Gracyalny et al. ..... 60/299
5,866,859 A * 2/1999 Karlsson et al. ..... 181/230
5,883,342 A * 3/1999 Wolpert ..... 181/230
5,959,262 A * 9/1999 Menzel ..... 181/231
6,044,926 A * 4/2000 Yamane et al. ..... 181/230
6,109,026 A * 8/2000 Karlsson et al. ..... 60/302
6,170,604 B1 * 1/2001 Menzel et al. ..... 181/230
6,341,662 B1 * 1/2002 Karlsson ..... 181/230
6,422,338 B1 * 7/2002 Menzel et al. ..... 181/230
6,978,605 B2 * 12/2005 Chiba et al. ..... 60/302
7,296,657 B2 11/2007 Ohno et al.

(Continued)

FOREIGN PATENT DOCUMENTS

EP 1 099 830 5/2001
EP 1 584 800 A1 10/2005

(Continued)

OTHER PUBLICATIONS

International Preliminary Report on Patentability, Chapter I of the Patent Cooperation Treaty, and Written Opinion dated Oct. 21, 2008 for PCT/JP2007/056402. 4 sheets.

(Continued)

*Primary Examiner* — Jeremy Luks

(74) *Attorney, Agent, or Firm* — Holtz, Holtz, Goodman & Chick, PC

(57) ABSTRACT

A muffler includes a muffler body in which a muffler chamber is formed by a base, a cover, and a baffle accommodated in the muffler chamber and disposed in the vicinity of the exhaust gas entry port of the muffler body. A guide portion which changes flow of an exhaust gas that enters from the exhaust gas entry port is integrally provided to the baffle by cut-and-raise of a portion of the baffle.

5 Claims, 6 Drawing Sheets

U.S. PATENT DOCUMENTS

| | | | | |
|---|---|---|---|---|
| 2001/0037912 | A1* | 11/2001 | Menzel | 181/231 |
| 2003/0173148 | A1* | 9/2003 | Andersson et al. | 181/272 |
| 2004/0154860 | A1* | 8/2004 | Joost et al. | 181/258 |
| 2005/0150716 | A1* | 7/2005 | Nasuno et al. | 181/231 |
| 2005/0224284 | A1* | 10/2005 | Ohno et al. | 181/272 |

FOREIGN PATENT DOCUMENTS

| | | | |
|---|---|---|---|
| JP | 57-50923 | B2 | 10/1982 |
| JP | 03-32737 | Y2 | 7/1991 |
| JP | 4-30331 | Y2 | 7/1992 |
| JP | 4-100014 | U | 8/1992 |
| JP | 08-338227 | A | 12/1996 |
| JP | 2005-299419 | A | 10/2005 |

OTHER PUBLICATIONS

English Language International Search Report dated Jun. 19, 2007 issued in parent Appln. No. PCT/JP2007/056402.

Chinese Office Action dated Oct. 9, 2009 and English translation thereof issued in a counterpart Chinese Application No. 200780011047.6.

Extended European Search Report dated Nov. 22, 2010 (in English) in counterpart European Application No. 07739840.2.

Japanese Office Action dated Jul. 26, 2011 (and English translation thereof) in counterpart Japanese Application No. 2006-089011.

* cited by examiner

MUFFLER

This application is a U.S. National Phase Application under 35 USC 371 of International Application PCT/JP2007/056402 filed Mar. 27, 2007.

TECHNICAL FIELD

The present invention relates to a muffler for an engine installed in a portable work machine or the like.

BACKGROUND ART

Conventionally, an engine is often employed as a drive source of a portable working machine such as a chain saw and a brushcutter. As a matter of course, the engine is equipped with a silencing muffler. The muffler is typically attached to an engine body by multiple bolts that penetrate a muffler body. In addition, the muffler is sometimes provided with a baffle (also called a partition cylinder) for improving the strength of portions of the muffler body where the bolts are fastened and for changing a flow direction of an exhaust gas to a predetermined direction immediately after the exhaust gas has entered the muffler body (e.g., Patent Document 1).

The baffle disclosed in Patent Document 1 not only covers the exhaust port provided to the muffler body but also partitions the muffler chamber, so that the exhaust gas from the engine enters a space covered by the baffle and then is flowed to the muffler chamber through multiple holes perforated at predetermined positions in the baffle.

Patent Document 1: JP-UM-A-32737

DISCLOSURE OF THE INVENTION

Problems to be Solved by the Invention

However, in the case a muffler chamber is provided with a conventional baffle that partitions the muffler chamber, the exhaust gas that has flowed into the muffler chamber hits an inner wall of the muffler body opposite to the exhaust gas entry port. Because the inner wall is overheated, the durability is lowered. As the thickness of the muffler is reduced to respond to need for size reduction of portable work machines, the exhaust gas entry port and the inner wall are provided closer to each other, so that the inner wall becomes even more likely to be heated. Accordingly, more attention is focused on the deterioration of the durability of the heated inner wall.

To avoid such deterioration, a guide plate provided in the vicinity of the exhaust gas entry port to change the flow of the exhaust gas in a predetermined direction may be helpful. If such a guide plate is provided, the exhaust gas that has flowed into the chamber through the exhaust gas entry port hits the guide plate immediately after the entrance, so that the flow direction of the exhaust gas is changed to a predetermined direction. Accordingly, the inner wall of the muffler body opposite to the exhaust gas entry port is not directly hit by the exhaust gas, thereby being no longer overheated. Because the excessive heating is evaded, the thickness of the muffler body can be reduced to allow the thickness reduction of the overall application, and the thickness of individual members forming the muffler body can also be reduced to allow the weight reduction of the overall application.

However, such a guide plate needs to be fixed to the muffler body by spot welding or the like, so that the manufacturing process tends to be complicated, and size reduction is not sufficiently achieved because a portion of the muffler body needs to be devoted for a welding tab.

An object of the present invention is to provide a muffler that is less heat-affected by the exhaust gas to enhance thickness-reduction and size reduction of the muffler while facilitating manufacture of the muffler.

Means for Solving the Problems

A muffler according to an aspect of the present invention includes: a muffler body within which a muffler chamber is formed; and a baffle accommodated in the muffler chamber and disposed in the vicinity of the exhaust gas entry port of the muffler body, in which a guide portion which changes flow of an exhaust gas that enters from the exhaust gas entry port is integrally provided to the exhaust gas entry port of the muffler body or the baffle by a cut-and-raise processing of a portion of the muffler body or the baffle.

According to the aspect of the invention, the flowing direction of the exhaust gas having entered into the muffler body through the exhaust gas entry port is changed by the guide portion. With this arrangement, the exhaust gas does not directly hit the inner surface of the muffler body close to and opposite to the exhaust gas entry port. Accordingly, the inner surface avoids overheating so that heat effect is minimized, thereby allowing thickness reduction of the muffler. For example, the inner surface can be disposed closer to the exhaust gas entry port. In addition, because the guide portion is formed by a cut-and-raise processing, a welding tab or the like that are required when a separate member is fixed to the baffle by welding or the like is no longer necessary. Therefore, size reduction of and facilitation of manufacture of the muffler can be achieved.

In the above arrangement, it is preferable that an exhaust gas exit port through which the exhaust gas is discharged is provided to the muffler body, a meshed spark arrester is provided in the vicinity of the exhaust gas exit port, and a portion of the spark arrester is abutted to the baffle for positioning of the spark arrester.

With this arrangement, only by providing the baffle, the spark arrester can be positioned without misalignment, so that a dedicated positioning portion is no longer necessary. Thus, the positioning structure can be simplified.

BEST MODE FOR CARRYING OUT THE INVENTION

An embodiment of the present invention will be described below with reference to the drawings.

Figure 1:
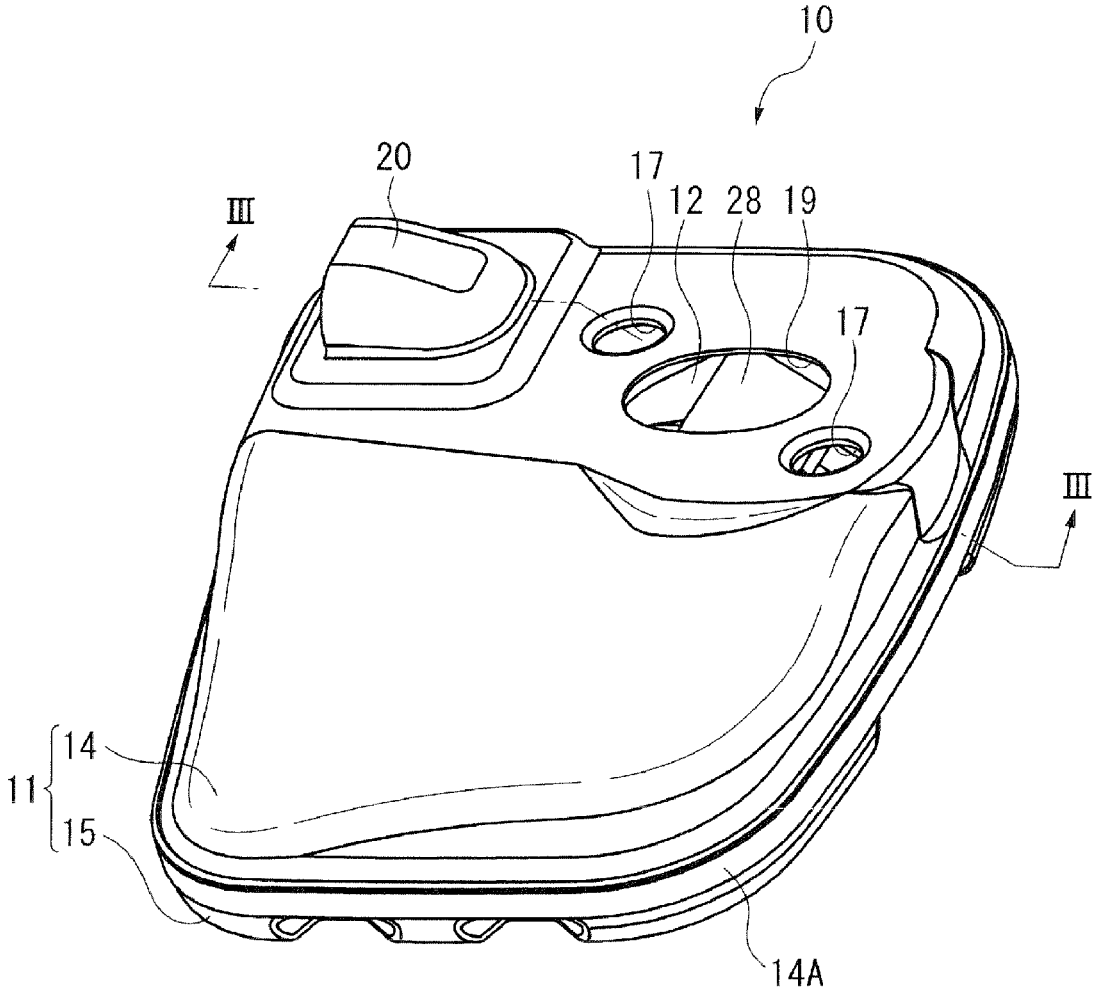
FIG. 1 is an overall perspective view showing a muffler according to an embodiment of the present invention.
Figure 2:
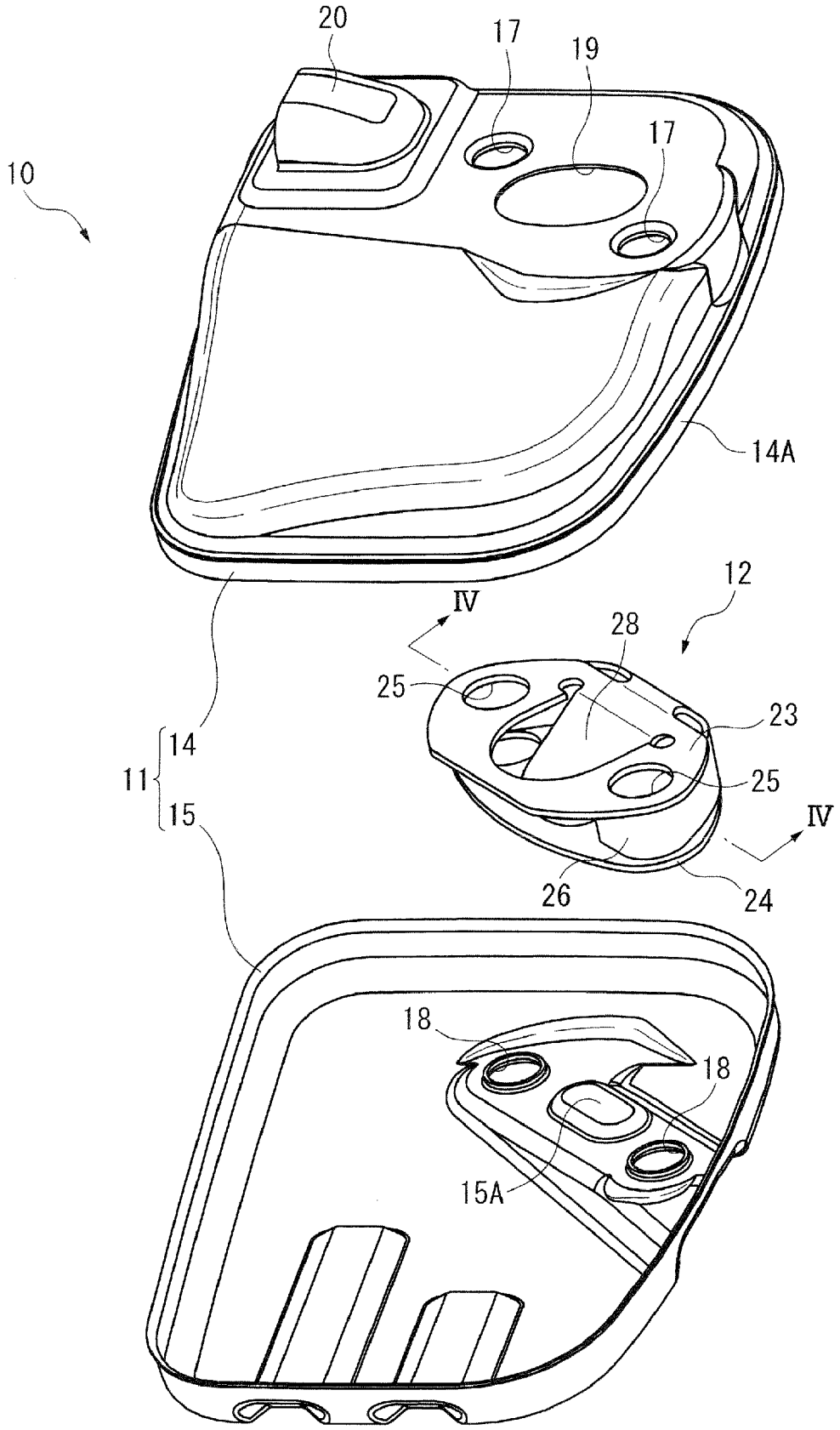
FIG. 2 is an exploded view of the muffler.
Figure 3:
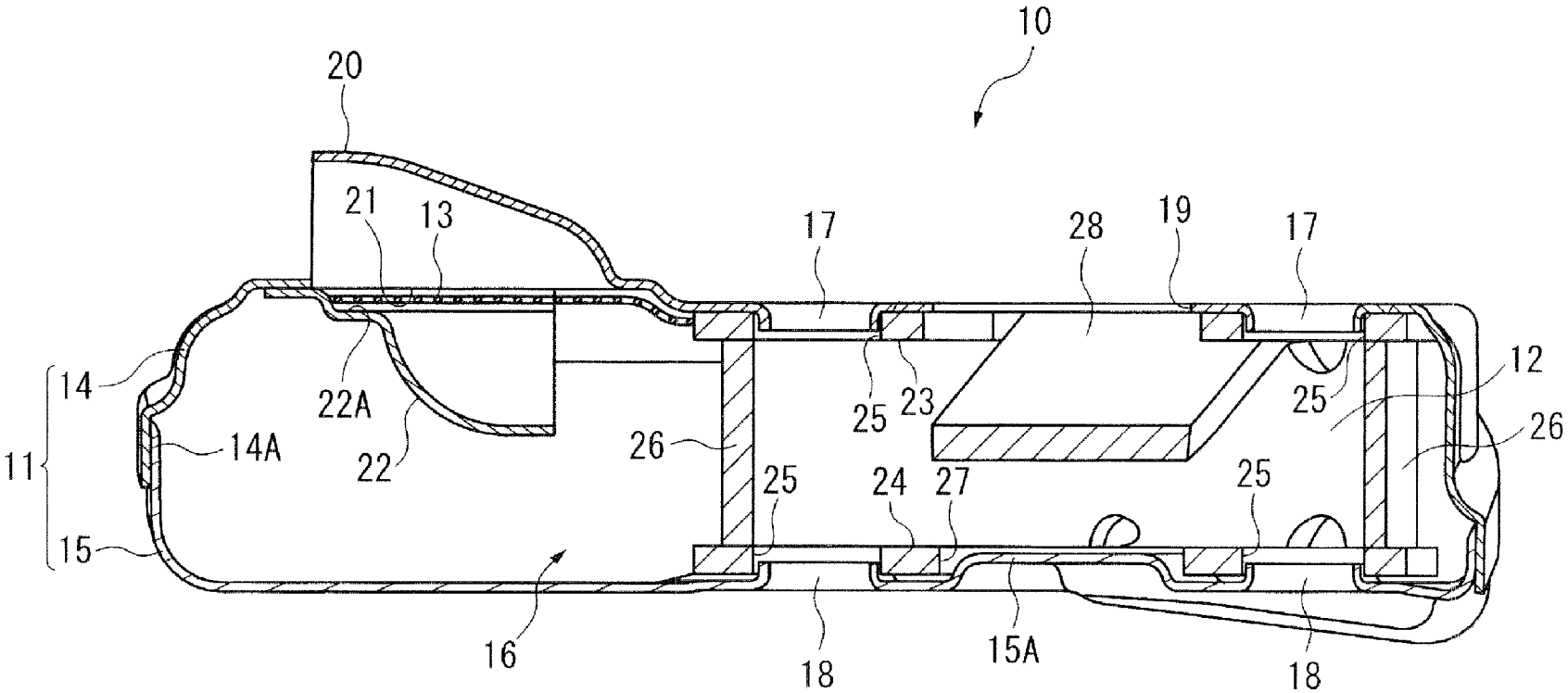
FIG. 3 is a cross-sectional view of the muffler taken along III-III line in FIG. 1.

FIG. 1 is an overall perspective view showing a muffler 10 according to the embodiment. FIG. 2 is an exploded perspective view showing the muffler 10. FIG. 3 is a cross-sectional view of the muffler 10 taken along III-III line in the FIG. 1.

The muffler 10 of the embodiment is for an engine installed in a portable work machine in the form of a chain saw and is disposed below the engine. Note that the muffler according to the present invention can be implemented not only in a chain saw but also in any suitable portable work machine such as a cut off saw, a brushcutter, and an engine blower.

Specifically, the muffler 10 includes: a muffler body 11 shaped in a thin box which is a quadrangle in plan view; a baffle 12 accommodated in the muffler body 11; and a spark arrester 13 (FIG. 3) which prevents discharge of fire spark from the muffler 10.

As shown in FIG. 2, the muffler body 11 includes a base 14 in an upper portion thereof and a cover 15 that fits with a fitting portion 14A continuously provided on a periphery of the base 14, the base 14 and the cover 15 being separable from each other. The cover 15 and the base 14 are made of a sheet metal. In the embodiment, a thickness of the sheet metal used in the base 14 and the cover 15 are approximately 0.4 mm. As shown in FIG. 3, the interior space formed by the base 14 and the cover 15 fitting with each other is a muffler chamber 16.

Pairs of bolt holes 17 and 18 are respectively provided to the base 14 and the cover 15 at positions corresponding to the position of each other. The entire muffler 10 is fixed to the engine by bolts (not shown) inserted in the bolt holes 17 and 18.

The base 14 is provided with an exhaust gas entry port 19 between the bolt holes 17. The exhaust gas from the engine enters the muffler chamber 16 through the exhaust gas entry port 19. Also in the base 14, an exhaust gas exit port 21 having a hood 20 formed by a cut-and-draw processing or the like on the sheet metal is provided at a corner portion of the base 14 adjacent to the exhaust gas entry port 19. The exhaust gas in the muffler chamber 16 is discharged through the exhaust gas exit port 21.

As shown in FIG. 3, a plate 22 oriented opposite to the orientation of the hood 20 is fixed to an inner surface of the base 14 at the exhaust exit port 21 by spot welding or the like. A step 22A for forming a gap of a predetermined width between the inner surface of the base 14 and the plate 22 is provided to the fixing side of the plate 22. The spark arrester 13 is inserted in the gap.

The baffle 12 is disposed at a position corresponding to the exhaust gas entry port 19 in the muffler chamber 16 and includes: a first surface 23 abutted to the inner surface of the base 14; a second surface 24 abutted to an inner surface of the cover 15; and a pair of belt-like rise portions 26 interposed between the first and second surfaces 23 and 24. The baffle 12 is also made of a sheet metal. In the embodiment, a thickness of the sheet metal is approximately 1.2 mm.

The surfaces 23 and 24 of the baffle 12 are provided with a total of four of penetration holes 25 that correspond to the bolt holes 17 and 18 of the muffler body 11. The above-mentioned bolts are inserted in the penetration holes 25. As shown in FIG. 3, bar ring portions formed on peripheries of the bolt holes 17 and 18 of the muffler body 11 are respectively fitted with the penetration holes 25 of the baffle 12, and a protrusion 15A provided to the cover 15 is fitted with an opening 27 of the second surface 24. With this arrangement, the baffle 12 is not misaligned with but is correctly positioned in the muffler chamber 16, so that the bolts are securely inserted. Furthermore, this arrangement prevents the baffle 12 from being installed in an orientation other than the orientation of the baffle 12 shown in FIG. 3.

When the muffler 10 is attached to the engine by the bolts that penetrate the baffle 12, the rise portions 26 of the baffle 12 provided in a manner surrounding the penetration holes 25 favorably resist the force applied by the fastening of the bolts, thereby restraining a deformation of the muffler body 11 caused by the fastening of the bolts. In other words, the baffle functions as a reinforcement member that reinforces the portions fastened by the bolts.

Figure 4:
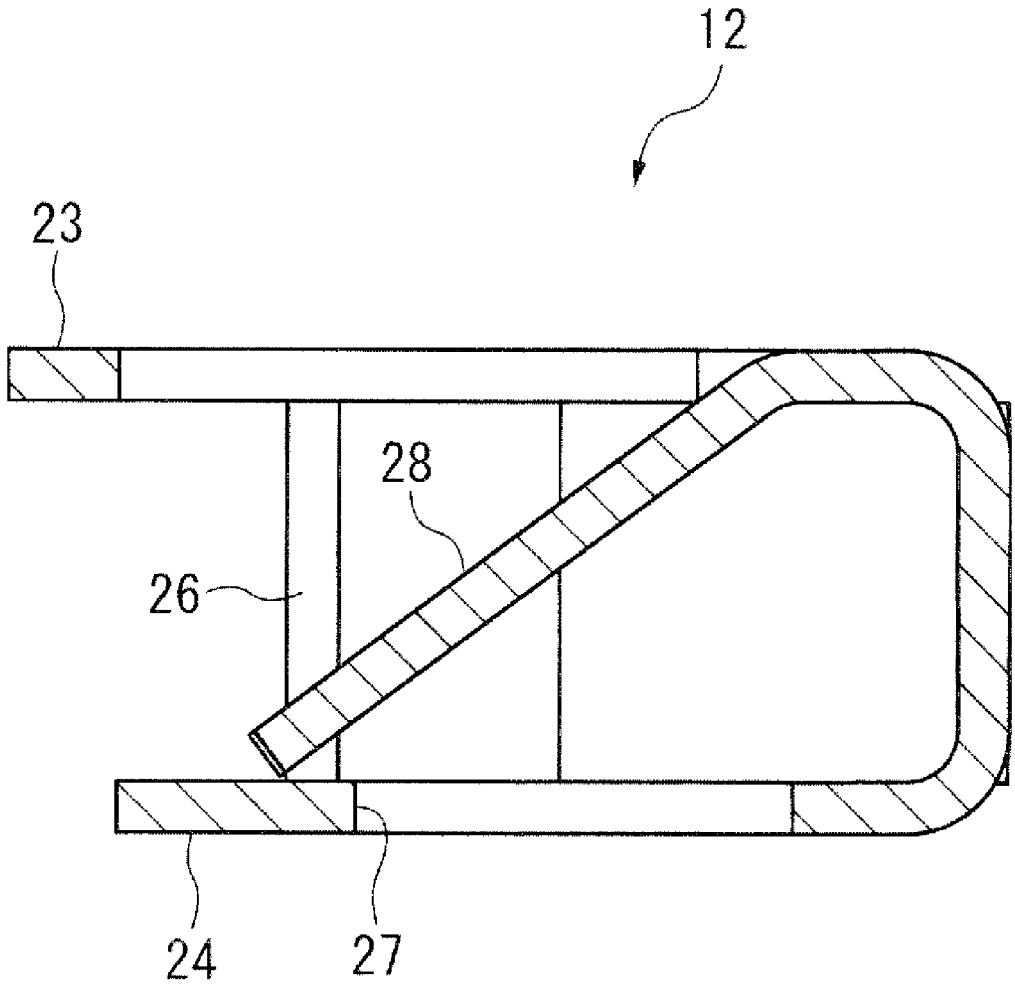
FIG. 4 is a cross-sectional view of a baffle taken along IV-IV line in FIG. 2.

As shown in FIG. 4, the first surface 23 of the baffle 12 is integrally provided with a tongue-like guide portion 28 formed by a cut-and-raise processing on the sheet metal. The guide portion 28 is disposed at a position corresponding to the exhaust gas entry port 19 and inclined in a manner bended between the first and second surfaces 23 and 24 so that distal end of the guide portion 28 is directed downwardly in the figure.

The guide portion 28 changes the flow direction of the exhaust gas that has entered in the chamber through the exhaust gas entry port 19. Then, the exhaust gas flows in the muffler chamber 16 in a diagonal direction relative to the exhaust gas entry port 19, before being diffused in the entire muffler chamber 16. Thus, changing the flow of the exhaust gas is also a function of the baffle 12. This function prevents the inner surface of the cover 15 close to and opposite to the exhaust gas entry port 19 from being directly hit by the exhaust gas, thereby preventing the inner surface of the cover 15 from being overheated.

Figure 5:
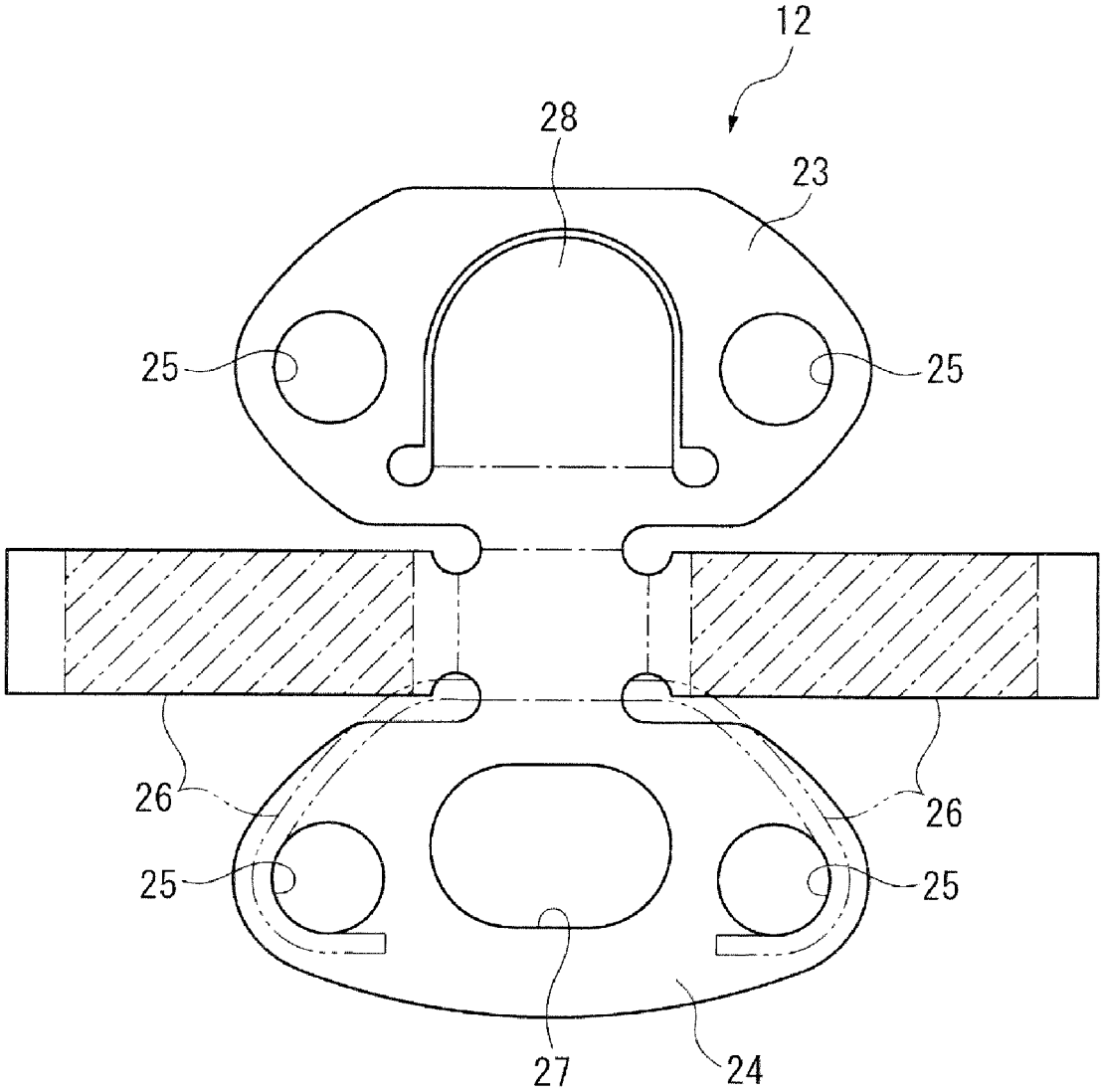
FIG. 5 is a developed view of the baffle.

FIG. 5 is a developed view of the baffle 12. The baffle 12 in a developed flat state obtained by blanking a sheet metal is bent at the dashed dotted lines in the figure to be formed into the three dimensional baffle 12. At this time, the guide portion 28 and the like may be bent in advance by a cut-and-raise processing before the entire baffle 12 undergoes a blanking process, or may be bent after the entire baffle 12 has gone a blanking process. In short, the processes may be conducted in any suitable order. In FIG. 5, incidentally, portions corresponding to the rise portions 26 of the three-dimensionally formed baffle 12 are shown in dashed two dotted lines in the second surface 24.

In the embodiment, as shown in FIG. 3, when the spark arrester 13 made of a metal mesh sheet is inserted in the gap of the plate 22, a base end of the spark arrester 13 relative to the inserting direction is abutted to the baffle 12, so that the spark arrester 13 is prohibited from escaping out of the gap. In other words, the baffle 12 functions also as a positioning member for the spark arrester 13.

The muffler 10 set forth above is set up as follows in an inverse vertical orientation with respect to the orientation shown in FIG. 2. Specifically, the plate 22 is fixed to the base 14 in advance. The spark arrester 13 is inserted in a gap formed when the plate 22 is fixed to the base 14. Subsequently, the three-dimensionally formed baffle 12 is disposed at a predetermined position in the base 14, over which the cover 15 is fitted with the base 14. The muffler 10 having been set up is attached to the engine by two bolts that are inserted through the bolt holes 17 and 18.

In the muffler 10 set forth above, because the baffle 12 is provided with the guide portion 28, the flow of the exhaust gas having entered from the exhaust gas entry port 19 can be changed by the guide portion 28. With this arrangement, the exhaust gas is prevented from directly hitting the inner surface of the cover 15 close to and opposite to the exhaust gas entry port 19. Because the inner surface of the cover 15 avoids overheating so that the heat effect is minimized, the inner surface can be disposed closer to the exhaust gas entry port 19, thereby contributing to the thickness reduction of the muffler 10. In addition, because the guide portion 28 is formed by a cut-and-raise processing, a welding tab or the like that are required when a separate member is fixed to the baffle by welding or the like is no longer necessary. Therefore, size reduction of and facilitation of manufacture of the muffler 10 can be achieved.

Figure 6:
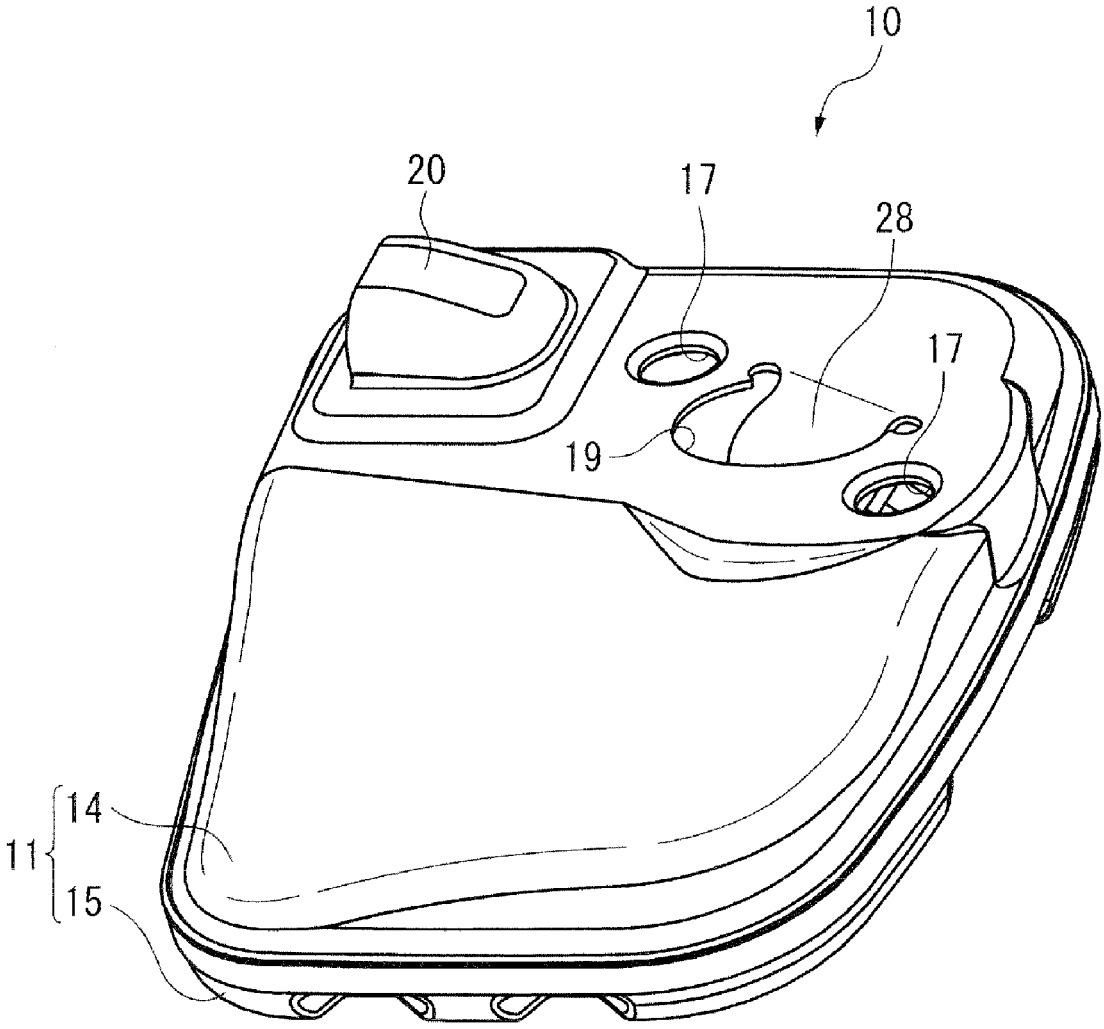
FIG. 6 is a perspective showing a modification of the present invention.

The scope of the invention is not limited to the above embodiment but includes other arrangements as long as an object of the invention is achieved. The following modifications are within the scope of the invention. For example, whereas the guide portion 28 is formed by a cut-and-raise of a portion of the baffle 12 in the embodiment, the guide portion may be formed by a cut-and-raise of a portion of the base 14 as shown in FIG. 6. In this case, the opening formed by the cut-and-raise becomes the exhaust gas entry port 19. In this case, thickness of the base 14, which is smaller than that of the baffle 12, needs to be increased by, for example, fixing a separate plate to the region of the guide portion 28 to improve heat-resistance. The baffle is only required to have a structure as a reinforcement member capable of preventing deformation by fastening of the bolts.

The best arrangements, methods, and the like for carrying out the invention have been heretofore disclosed, but the scope of the invention is not limited thereto. Although the invention is illustrated and described mainly with reference to a specified embodiment, those skilled in the art may modify the embodiment in shapes, amounts, and other specific arrangements to make a variety of modifications without departing from the spirit and scope of the invention.

The above disclosure limiting the shapes, amounts, and the like are merely exemplary statements for convenience of specifically describing the invention and do not limit the scope of the invention. Statements of members without part of or all of the limitations on the shapes, amounts, and the like are within the scope of the invention.

The invention claimed is:

1. A muffler, comprising:

a muffler body having a muffler chamber formed therein;

a baffle accommodated in the muffler chamber and disposed in a vicinity of an exhaust gas entry port of the muffler body, the baffle having a first abutting portion which abuts an inner surface of the muffler chamber, a second abutting portion which is opposed to the first abutting portion and which abuts an opposed inner surface of the muffler chamber, and a rise portion that is integrally formed with the baffle and extends from the first abutting portion to the second abutting portion; and a guide portion that changes a flow of an exhaust gas that enters from the exhaust gas entry port, wherein the guide portion is integrally provided to the baffle by a cut-and-raise processing of a portion of the baffle, and the guide portion has a thickness that is greater than a thickness of the muffler body, wherein bolt holes are provided on the opposing inner surfaces of the muffler chamber, the bolt holes including bar ring portions formed on peripheries thereof, and wherein the bar ring portions are engagable with penetration holes formed in the first and second abutting portions of the baffle such that the baffle is correctly positioned in the muffler chamber when the bar ring portions and the penetration holes are engaged.

2. The muffler according to claim 1, wherein:

an exhaust gas exit port through which the exhaust gas is discharged is provided to the muffler body, a mesh spark arrester is provided in a vicinity of the exhaust gas exit port, and a portion of the spark arrester is abutted to the baffle, for positioning of the spark arrester.

3. The muffler according to claim 1, wherein the thickness of the guide portion is approximately three times the thickness of the muffler body.

4. The muffler according to claim 3, wherein:

an exhaust gas exit port through which the exhaust gas is discharged is provided to the muffler body, a mesh spark arrester is provided in a vicinity of the exhaust gas exit port, and a portion of the spark arrester is abutted to the baffle, for positioning of the spark arrester.

5. The muffler according to claim 1, wherein the rise portion resists against a force applied during installation of the muffler body on an engine so as to prevent deformation of the muffler main body during the installation.

* * * * *